US010168642B2

(12) United States Patent
Ohhira et al.

(10) Patent No.: US 10,168,642 B2
(45) Date of Patent: Jan. 1, 2019

(54) DEVELOPING DEVICE AND IMAGE FORMING APPARATUS AND PROCESS CARTRIDGE INCORPORATING SAME

(71) Applicants: Tatsuya Ohhira, Kanagawa (JP); Masayuki Yamane, Kanagawa (JP); Keiichi Yoshida, Kanagawa (JP); Atsushi Kurokawa, Kanagawa (JP); Toshiki Hayashi, Kanagawa (JP); Yuuki Tsuchiya, Tokyo (JP)

(72) Inventors: Tatsuya Ohhira, Kanagawa (JP); Masayuki Yamane, Kanagawa (JP); Keiichi Yoshida, Kanagawa (JP); Atsushi Kurokawa, Kanagawa (JP); Toshiki Hayashi, Kanagawa (JP); Yuuki Tsuchiya, Tokyo (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 15/718,501

(22) Filed: Sep. 28, 2017

(65) Prior Publication Data

US 2018/0143568 A1 May 24, 2018

(30) Foreign Application Priority Data

Nov. 24, 2016 (JP) ..... 2016-228273

(51) Int. Cl.
*G03G 15/08* (2006.01)
*G03G 21/18* (2006.01)

(52) U.S. Cl.
CPC ..... *G03G 15/0891* (2013.01); *G03G 21/1814* (2013.01)

(58) Field of Classification Search
CPC ..... G03G 15/0889; G03G 15/0891; G03G 15/0893; G03G 21/1814; G03G 2215/0822; G03G 2215/0827; G03G 2215/0838
See application file for complete search history.

(56) References Cited

U.S. PATENT DOCUMENTS

2010/0040391 A1* 2/2010 Uno ..... G03G 21/105 399/53
2014/0056621 A1* 2/2014 Hashimoto ..... G03G 15/0889 399/254

(Continued)

FOREIGN PATENT DOCUMENTS

JP 2006-243512 9/2006
JP 2009-098269 5/2009

(Continued)

*Primary Examiner* — Sophia S Chen
(74) *Attorney, Agent, or Firm* — Harness, Dickey & Pierce, P.L.C.

(57) ABSTRACT

A developing device includes upper and lower developer containing portions to contain developer, arranged in a vertical direction, a first developer conveyor to convey developer in the upper developer containing portion to a first side in an axial direction of the first developer conveyor, a second developer conveyor to convey developer in the lower developer containing portion to a second side opposite the first side, a developer-lifting area in which the developer is lifted from the lower developer containing portion to the upper developer containing portion, a first lifting area gear to rotate the first developer conveyor, a second lifting area gear to rotate the second developer conveyor, and a lifting area input gear to input a driving force to the developing device. The lifting area input gear is coupled to the first lifting area gear and coupled via the first lifting area gear via to the second lifting area gear.

10 Claims, 7 Drawing Sheets

(56) References Cited

U.S. PATENT DOCUMENTS

| | | | | |
|---|---|---|---|---|
| 2014/0348543 | A1* | 11/2014 | Kashimoto ..... | G03G 15/0889<br>399/257 |
| 2015/0268584 | A1* | 9/2015 | Tanaka ..... | G03G 15/0891<br>399/254 |
| 2015/0338777 | A1* | 11/2015 | Matsumoto ..... | G03G 15/0893<br>399/254 |
| 2017/0090342 | A1 | 3/2017 | Ohhira et al. | |
| 2017/0123349 | A1* | 5/2017 | Takahashi ..... | G03G 15/0893 |

FOREIGN PATENT DOCUMENTS

| | | |
|---|---|---|
| JP | 2011-186243 | 9/2011 |
| JP | 2015-094805 | 5/2015 |

* cited by examiner

Comparative Example

DEVELOPING DEVICE AND IMAGE FORMING APPARATUS AND PROCESS CARTRIDGE INCORPORATING SAME

CROSS-REFERENCE TO RELATED APPLICATIONS

This patent application is based on and claims priority pursuant to 35 U.S.C. § 119(a) to Japanese Patent Application No. 2016-228273, filed on Nov. 24, 2016, in the Japan Patent Office, the entire disclosure of which is hereby incorporated by reference herein.

BACKGROUND

Technical Field

This disclosure generally relates to a developing device, and a process cartridge and an image forming apparatus, such as a copier, a printer, a facsimile machine, or a multifunction peripheral (MFP) having such a function, that include the developing device.

Description of the Related Art

There are developing devices that include developer containing portions (enclosed by a casing of the developing device), such as a supply portion and a stirring portion arranged in a vertical direction (one above another).

Such a developing device includes an upper developer conveyor (a first developer conveyor), such as a supply screw, to convey developer in the upper developer containing portion and a lower developer conveyor (a second developer conveyor), such as a stirring screw, to convey developer in the lower developer containing portion, respectively. The upper developer conveyor conveys the developer to one side in the axial direction of the developer conveyor, and the lower developer conveyor conveys the developer to the opposite side. The developing device further includes a developer-lifting area in which the developer is lifted from the lower developer containing portion to the upper developer containing portion.

SUMMARY

According to an embodiment of this disclosure, a developing device includes an upper developer containing portion and a lower developer containing portion to contain developer, arranged in a vertical direction; a first developer conveyor to convey developer in the upper developer containing portion to a first side in an axial direction of the first developer conveyor; a second developer conveyor to convey developer in the lower developer containing portion to a second side opposite the first side; and a developer-lifting area in which the developer is lifted from the lower developer containing portion to the upper developer containing portion. The developing device further includes a first drive gear to rotate the first developer conveyor, a second drive gear to rotate the second developer conveyor, and a drive input gear to input a driving force to the developing device. The drive input gear is coupled to the first drive gear and coupled via the first drive gear via to the second drive gear to transmit the driving force to the second drive gear via the first drive gear.

In another embodiment, a process cartridge to be removably mounted in an image forming apparatus includes the above-described developing device and at least one of an image bearer to bear an electrostatic latent image developed by the developing device, a charger to charge the image bearer, and a cleaning device to clean the image bearer.

In yet another embodiment, an image forming apparatus includes an image bearer to bear an electrostatic latent image, and the above-described developing device to develop the electrostatic latent image with the developer.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein.

Figure 1:
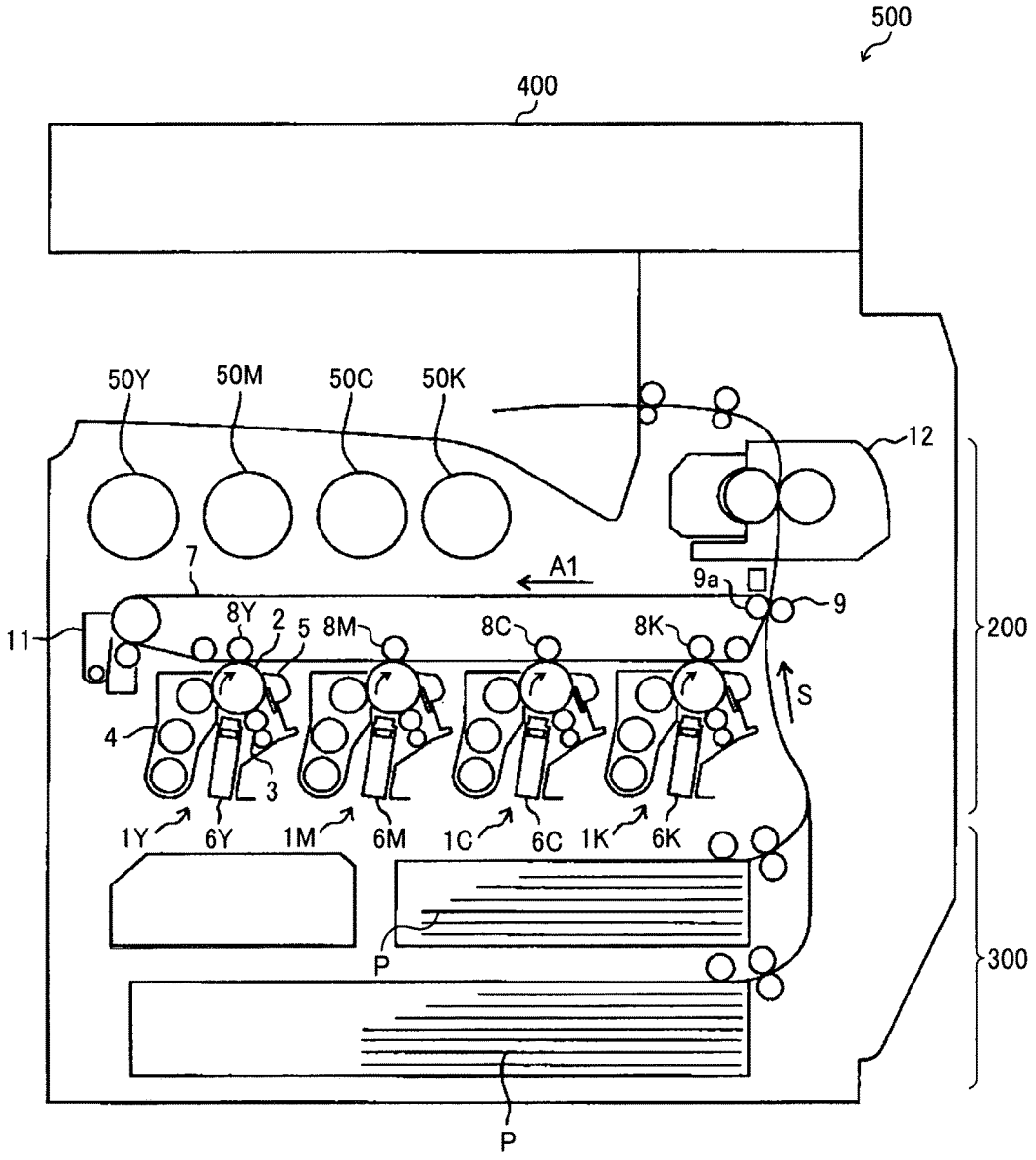
FIG. 1 is a schematic view of an image forming apparatus according to an embodiment.

The accompanying drawings are intended to depict embodiments of the present invention and should not be interpreted to limit the scope thereof. The accompanying drawings are not to be considered as drawn to scale unless explicitly noted.

DETAILED DESCRIPTION

In describing embodiments illustrated in the drawings, specific terminology is employed for the sake of clarity. However, the disclosure of this patent specification is not intended to be limited to the specific terminology so selected, and it is to be understood that each specific element includes all technical equivalents that operate in a similar manner and achieve a similar result.

Referring now to the drawings, wherein like reference numerals designate identical or corresponding parts throughout the several views thereof, and particularly to FIG. 1, an image forming apparatus according to an embodiment of this disclosure is described. As used herein, the singular forms "a", "an", and "the" are intended to include the plural forms as well, unless the context clearly indicates otherwise.

FIG. 1 is a schematic view of an image forming apparatus 500 including a developing device according to an embodiment. For example, the image forming apparatus 500 is an electrophotographic copier (hereinafter called "an image forming apparatus 500.

As illustrated in FIG. 1, the image forming apparatus 500 includes a printer body 200 to perform image formation, a sheet feeder 300 including a plurality of sheet feeding trays, and a scanner 400 mounted on the upper side of the printer body 200.

The printer body 200 includes four process cartridges 1 (1Y, 1M, 1C, and 1K) as image forming devices (or process units), an intermediate transfer belt 7 serving as an intermediate transferor, and a fixing device 12. The intermediate transfer belt 7 is looped around a plurality of tension rollers and rotates in the direction indicated by arrow Al illustrated in FIG. 1 (hereinafter "belt travel direction"). The image forming apparatus 500 further includes exposure devices 6 (6Y, 6M, 6C, and 6K) to write electrostatic latent images on drum-shaped photoconductors 2 (1Y, 1M, 1C, and 1K) of the process cartridges 1 (Y, M, C, and K), respectively.

Note that the suffixes Y, M, C, and K attached to each reference numeral of the four process cartridges 1 indicate that components indicated thereby are used for forming yellow, magenta, cyan, and black images, respectively.

The process cartridges 1 are similar in structure except the color of toner used therein. Therefore, in FIG. 1, reference numerals of the photoconductor 2, a charging device 3, a developing device 4, and a photoconductor cleaning device 5 are given to those of only the process cartridge 1Y, without the suffices indicating the color of toner (Y, M, C, and K).

Since the four process cartridges 1 have a similar configuration except the color of toner used therein, the suffixes Y, M, C, and K may be omitted in the description below when color discrimination is not necessary.

The process cartridge 1 is a unit including the drum-shaped photoconductor 2 (an image bearer or latent image bearer), the charging device 3 (a charger), the developing device 4, and the photoconductor cleaning device 5 (a cleaning device), which are hold in a common unit casing. The process cartridge 1 can be installed in the image forming apparatus 500 (the printer body 200) and removed therefrom by releasing a stopper.

The photoconductor 2 rotates clockwise in the drawing as indicated by an arrow illustrated in FIG. 1.

The charging device 3 includes a charging roller. The charging device 3 is pressed against the surface of the photoconductor 2 to rotate as the photoconductor 2 rotates. In image formation, a high-voltage power source applies a predetermined bias voltage to the charging device 3, and the charging device 3 electrically charges the surface of the photoconductor 2 uniformly.

Although the process cartridge 1 according to the present embodiment includes the roller-shaped charging device 3 that contacts the surface of the photoconductor 2, alternatively, a contactless charger such as a corona charger may be used.

Figure 2:
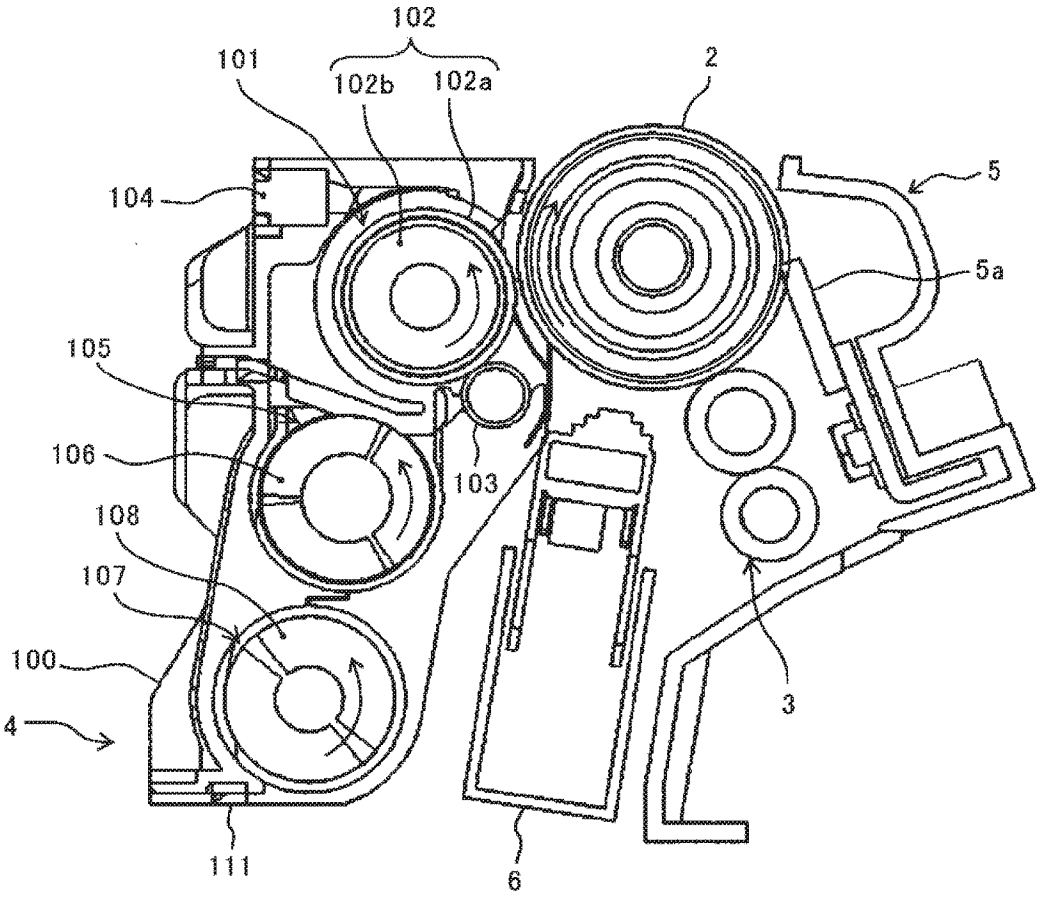
FIG. 2 is a schematic cross-sectional view of a process cartridge according to an embodiment.

The photoconductor cleaning device 5 includes a cleaning blade 5*a* disposed in contact with the photoconductor 2 to scrape off residual toner remaining on the photoconductor 2 downstream from the position opposing the intermediate transfer belt 7 in the direction of rotation of the photoconductor 2 (see FIG. 2).

The four process cartridges 1 form yellow (Y), cyan (C), magenta (M), and black (B) toner images on the respective photoconductors 2. The four process cartridges 1 are disposed side by side in the belt travel direction indicated by arrow A1. The respective toner images formed on the photoconductors 2 are transferred therefrom and superimposed sequentially one on another on the intermediate transfer belt 7 (a primary transfer process) to form a multicolor toner image (a visible image) on the intermediate transfer belt 7.

In FIG. 1, primary transfer rollers 8 (8Y, 8M, 8C, and 8K) serving as primary transferors are disposed opposite the photoconductors 2, respectively, via the intermediate transfer belt 7.

Receiving a primary transfer bias from a high-voltage power source, the primary transfer roller 8 generates a primary-transfer electrical field between the photoconductor 2 and the primary transfer roller 8. With the primary-transfer electrical field generated between the photoconductor 2 and the primary transfer roller 8, the toner images are transferred from the photoconductors 2, respectively, onto the intermediate transfer belt 7.

As one of the plurality of tension rollers around which the intermediate transfer belt 7 is entrained is rotated by a driving motor, the intermediate transfer belt 7 rotates in the belt travel direction indicated by arrow A1 illustrated in FIG. 1. The toner images are sequentially transferred onto the rotating intermediate transfer belt 7 and superimposed one on another thereon, forming a multicolor toner image.

Of the plurality of tension rollers, a secondary-transfer backup roller 9*a* is disposed downstream from the four process cartridges 1 in the belt travel direction indicated by arrow A1 and presses against a secondary transfer roller 9 via the intermediate transfer belt 7. The contact portion between the secondary transfer roller 9 and the intermediate transfer belt 7 is called a secondary transfer nip. A predetermined voltage is applied to the secondary transfer roller 9 or the secondary-transfer backup roller 9*a* to generate a secondary-transfer electrical field therebetween.

Transfer sheets P (i.e., recording media) fed from the sheet feeder 300 are transported in the direction indicated by arrow S illustrated in FIG. 1 (hereinafter "sheet conveyance direction") and pass through the secondary transfer nip. At that time, the multicolor toner image is transferred from the intermediate transfer belt 7 onto the transfer sheet P by the effects of the secondary-transfer electrical field generated between the secondary transfer roller 9 and the secondary-transfer backup roller 9*a* (a secondary transfer process).

The fixing device 12 is disposed downstream from the secondary transfer nip in the sheet conveyance direction. The fixing device 12 fixes the multicolor toner image with heat and pressure on the transfer sheet P that has passed through the secondary transfer nip, after which the transfer sheet P is discharged outside the image forming apparatus 500.

Meanwhile, a belt cleaner 11 removes toner remaining, untransferred onto the transfer sheet P, on the intermediate transfer belt 7 after the secondary transfer process.

As illustrated in FIG. 1, toner bottles 50 (50Y, 50M, 50C, and 50K) containing yellow, magenta, cyan, and black toners are disposed above the intermediate transfer belt 7, removably from the image forming apparatus 500.

A toner supply device supplies the toner from the toner bottle 50 to the developing device 4 of the corresponding color.

Referring to FIG. 2, the process cartridge 1 is described below.

FIG. 2 is a schematic cross-sectional view of the process cartridge 1.

The process cartridge 1 according to the present embodiment includes the developing device 4, the photoconductor 2, the charging device 3, and the photoconductor cleaning device 5. For example, the photoconductor 2, the charging device 3, and the photoconductor cleaning device 5 are united into a photoconductor unit.

For example, a light-emitting diode (LED) array is used as a light-emitting element of the exposure device 6 to enable exposure throughout an image formation area of the photoconductor 2 in the longitudinal direction of the photoconductor 2.

The developing device 4 is a developing device of vertical biaxial-circulation. A casing 100 of the developing device 4 serves as a developer container and includes a stirring compartment 107 and a supply compartment 105 separated from each other and communicating each other both end portions in the longitudinal direction of the developing device 4. The stirring compartment 107 is to stir supplied toner, and the supply compartment 105 is to supply developer to the developing roller 102. It is not necessary that an inner wall separates substantial portions of the supply compartment 105 and the stirring compartment 107 from each other.

In the supply compartment 105 and the stirring compartment 107, a supply screw 106 and a stirring screw 108 (developer conveyors) are disposed, respectively, to circulate the developer.

The developing roller 102 includes a developing sleeve 102*a* and a magnet roller 102*b*. The developing roller 102 is 16 mm in diameter. The casing 100 further includes a developing compartment 101 in which the developing roller 102 is disposed. The developer in the supply compartment 105 is conveyed by the supply screw 106 to a position close to the developing roller 102. Then, the developer is attracted to the developing roller 102 by a magnetic force. After a developer regulator 103 regulates the layer thickness of the developer (amount of developer conveyed) on the developing roller 102, the developer is conveyed to a developing range opposing the photoconductor 2.

Subsequently, the developer is returned by the developing roller 102 into the developing device 4 (the developing compartment 101). Then, due to a repulsive magnetic force of the developing roller 102, the developer leaves the developing roller 102 and returns into the supply compartment 105.

The developer regulator 103 is a magnetic metal rod. The developer regulator 103 is disposed at a distance (a gap called "doctor gap") from the developing roller 102 and secured to the casing 100.

As the developer is returned into the developing device 4, a magnetic brush of developer generates, between the casing 100 and the magnetic brush, airflow trending into the developing device 4. The airflow prevents the scattering of toner that is not used in image developing. Since the pressure inside the developing device 4 increases at that time, the developing device 4 further includes a vent provided with a pressure-release filter 104.

The developing device 4 according to the present embodiment uses two component developer including toner and carrier to develop (visualize) an electrostatic latent image on an image bearer (or a latent image bearer).

In such a developing device, to attain reliable toner image quality, the toner concentration and the charge amount of the developer are kept constant. The toner concentration is adjusted with the amount of toner consumed in developing and the amount of supplied toner. The developer is charged by triboelectric charging while the carrier and the toner are mixed.

In the developing range, the toner attracted to the carrier adheres to the electrostatic latent image (an image portion) on the image bearer, being affected by the electrical field generated between the developing roller (i.e., a developer bearer) and the image bearer. At that time, the force of the electrical field in the developing range excels the electrostatic force with the carrier, and the toner leaves the carrier and moves to the image bearer.

In biaxial-circulation developing devices, the developer containing compartment (casing) include a stirring portion to stir and charge supplied toner and a supply portion to supply the developer to the developer bearer. Conventionally, in such biaxial-circulation developing devices, two developer conveyors are typically disposed side by side (in a horizontal arrangement) to circulate the developer between the stirring portion and the supply portion.

Recently, a demand for compact image forming apparatuses is increasing. Since full-color image forming apparatuses include a plurality of developing devices, it is preferred to make the developing device compact. One approach to make the developing device compact is arranging the stirring portion and the supply portion one above the other in a vertical direction or substantially vertical direction. This arrangement can reduce the width of the developing device to reduce the arrangement intervals of the developing devices (developing units) for yellow, magenta, cyan, and black.

When the stirring portion and the supply portion are disposed in the vertical arrangement, however, the developer is lifted against the gravity to move the developer between the stirring portion and the supply portion. In such a developer-lifting area, the developer is likely to accumulate. The amount of developer on the lower side of the developer-lifting area is greater, and the amount of developer on the upper side becomes insufficient. When the supply portion is on the upper side, shortage of developer can cause image failure such as fading.

In the arrangement in which the stirring portion and the supply portion are arrangement in the vertical (or substantially vertical) direction, an ingenuity is required to achieve smooth transfer of developer and inhibit stagnant of developer.

For example, the developer conveyor disposed in the lower developer containing portion is configured such that the force to convey developer in the direction perpendicular to the axis of the developer conveyor increases toward the downstream side in the developer conveyance direction of the lower developer conveyor. For example, a paddle is provided to a portion of the developer conveyor near the developer-lifting area.

Compared with a communicating portion to transfer the developer from one compartment to another compartment in the horizontal arrangement, in the developer containing compartment of vertical arrangement, the pressure of developer easily increases in the developer-lifting area.

Accordingly, it is possible that, immediately after the driving of the developer conveyors are started, the pressure of developer sharply increases in the developer-lifting area. That is, compared with the horizontal arrangement, clogging with developer and aggregation of developer can occur easily.

In view of the foregoing, the developing device 4 according to the present embodiment has the following features.

Next, descriptions are given in detail below of the developing device 4 according to the present embodiment, referring to the drawings.

Figure 3A:
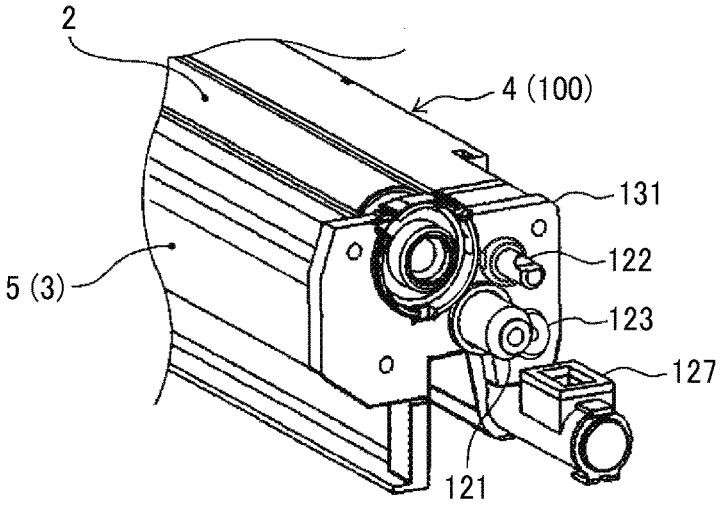
FIGS. 3A and 3B are schematic perspective views of the process cartridge illustrated in FIG. 2.
Figure 3B:
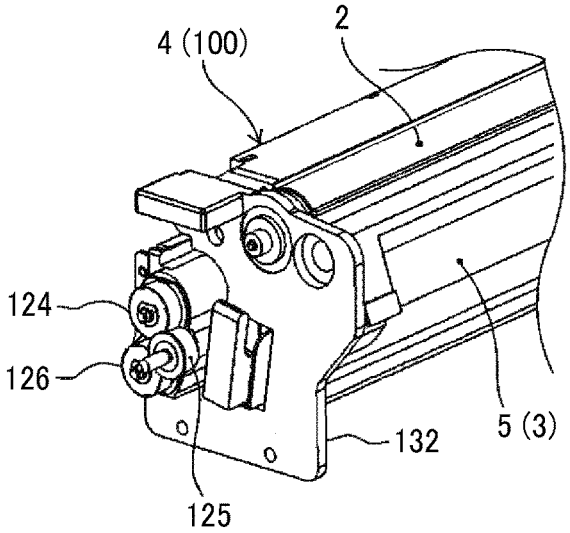

Initially, a description is given with reference to FIGS. 3A and 3B, which are perspective views of the process cartridge 1. FIG. 3A is a schematic perspective view of the process cartridge 1 as viewed from the back side in the direction of installation of the process cartridge 1 into the image forming apparatus 500. FIG. 3B is a schematic perspective view of the process cartridge 1 as viewed from the front side in the direction of installation of the process cartridge 1 into the image forming apparatus 500.

Figure 4:
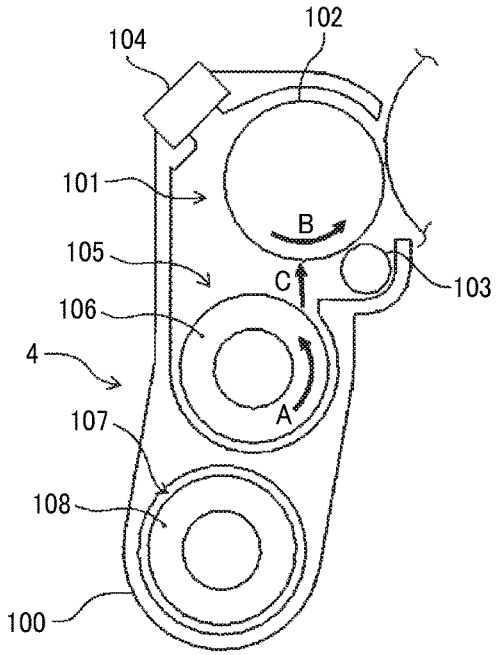
FIG. 4 is an end-on cross-sectional view of a vertical biaxial-circulation developing device according to an embodiment, illustrating supply of developer from a supply portion to a developing roller.
Figure 5:
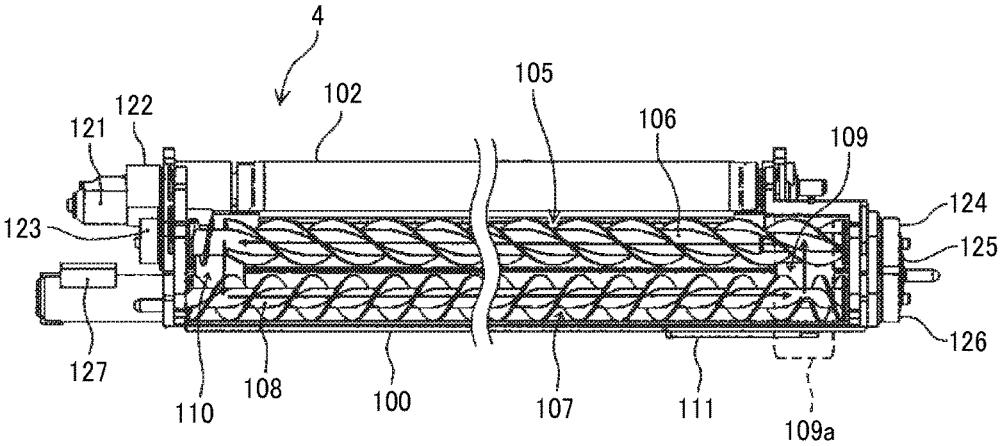
FIG. 5 is a cross-sectional view of the vertical biaxial-circulation developing device in a longitudinal direction thereof.
Figure 6:
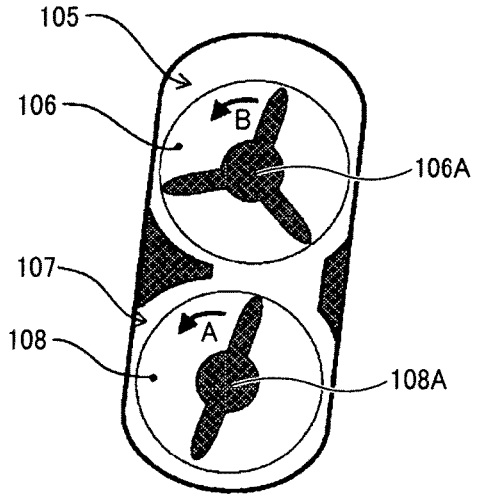
FIG. 6 is an end-on axial view of a lifting area through which a supply compartment communicates with a stirring compartment, in the vertical biaxial-circulation developing device illustrated in FIG. 4.

FIG. 4 is an end-on axial view of the developing device 4 and illustrates supply of developer from the supply compartment 105 onto the developing roller 102. FIG. 5 is a cross-sectional view of the vertical biaxial-circulation developing device 4 in the longitudinal direction. FIG. 6 is an end-on axial view of a lifting area 109*a* of the vertical biaxial-circulation developing device 4 where the developer is lifted from the stirring compartment 107 to the supply compartment 105.

As illustrated in FIGS. 3A and 3B, in the process cartridge 1, the developing device 4, the charging device 3, the photoconductor cleaning device 5, and the photoconductor 2 are attached to and positioned by a back plate 131 and a front plate 132. In the present embodiment, a distance (gap) between the developing roller 102 of the developing device 4 and the photoconductor 2 is set to 0.3 mm.

A driving motor of the image forming apparatus 500 rotates an input gear 121 (illustrated in FIG. 3A, serving as a drive input gear) to input a driving force to the developing device 4.

The input gear 121 of the developing device 4 is an idler gear having a stationary shaft attached to or integral with the casing 100. The input gear 121 meshes with (or is coupled to) a developing roller gear 122 (i.e., a developing drive gear) to drive the developing roller 102 and a supply input gear 123 (i.e., a first drive gear) to drive the supply screw 106.

With such a gear train configuration, as illustrated in FIG. 4, the rotation direction (indicated by arrow B) of the developing roller 102 is identical to the rotation direction (indicated by arrow A) of the supply screw 106 to facilitate supply of developer onto the developing roller 102. With the rotation directions being identical, the developer can be conveyed closer to the developing roller 102.

The image forming apparatus 500 includes a high-pressure power supply to apply a predetermined bias to the rotation shaft of the developing roller 102 illustrated in FIG. 3A. To a toner supply inlet 127 of the developing device 4, toner is supplied from the toner bottle 50 mounted in the image forming apparatus 500.

As illustrated in FIG. 3A, the input gear 121 meshes with the developing roller gear 122 and the supply input gear 123 attached to one end side (back side in the direction of installation of the process cartridge 1) of a rotation shaft 106A (illustrated in FIG. 6) of the supply screw 106. As illustrated in FIG. 3B, a supply output gear 124 is attached to the other end side of the rotation shaft 106A of the supply screw 106. From the supply output gear 124, the rotation driving force of the supply screw 106 is transmitted via a transmission gear 125 (an idler gear) to a stirring input gear 126 (a second drive gear) to drive the stirring screw 108. The stirring input gear 126 is attached to a rotation shaft 108A (illustrated in FIG. 6) of the stirring screw 108.

Additionally, as illustrated in FIG. 5, the developing device 4 includes the supply compartment 105 and the stirring compartment 107 separated from each other by the casing 100 except communicating openings (a lifting opening 109 and a falling opening 110) disposed in both end portions in the longitudinal direction of the developing device 4.

The communicating openings are rectangular and 25 mm in the longitudinal direction and 10 mm in the direction (width direction) perpendicular to the surface of the paper on which FIG. 5 is drawn.

The supply screw 106 and the stirring screw 108 convey the developer in the directions respectively indicated by arrows illustrated in FIG. 5 to circulate the developer between the supply compartment 105 and the stirring compartment 107.

The developer that has been used in image developing on the developing roller 102 is returned into the supply compartment 105 by the repulsive magnetic force exerted on the developing roller 102 and received in the stirring compartment 107 through the falling opening 110, which is the communicating opening on the left in FIG. 5.

The developer returned into the stirring compartment 107 is mixed with the toner supplied from the toner supply inlet 127 disposed in the stirring compartment 107, and then the developer is again conveyed to the supply compartment 105. Thus, the toner concentration in the developer supplied to the developing roller 102 can be kept at a desirable concentration. The stirring compartment 107 is provided with a toner concentration sensor 111. The amount of toner supplied is determined to attain the desirable toner concentration by a controller of the image forming apparatus 500. The controller can be a computer including a central processing unit (CPU) and associated memory units (e.g., ROM, RAM, etc.). The computer performs various types of control processing by executing programs stored in the memory.

In the developing device 4 of vertical biaxial-circulation, in the lifting area 109*a* where the developer is forwarded from the stirring compartment 107 to the supply compartment 105, the developer tends to stagnate since the developer is conveyed against the gravity. Therefore, to circulate the developer smoothly, the following structure and a method are used.

Descriptions are given below of the structures of the supply screw 106 and the stirring screw 108 and the driving method thereof.

The supply screw 106 disposed in the supply compartment 105 is 15 mm in outer diameter (the diameter of the screw blade). The supply screw 106 includes a small-diameter portion disposed in the developer-lifting area 109*a* illustrated in FIG. 6 and a large diameter portion (other portion than the small-diameter portion) different in the shaft diameter. The small-diameter portion is 6 mm in shaft diameter and the large-diameter portion is 8 mm in shaft diameter. The stirring screw 108 disposed in the stirring compartment 107 is 15 mm in outer diameter (the diameter of screw blade), and the shaft diameter thereof is 6 mm. The supply screw 106 and the stirring screw 108 are 290 mm in length. However, the supply screw 106 is triple threaded and has a lead is 45 mm, while the stirring screw 108 is double threaded and has a lead of 28 mm.

In the developer-lifting area 109*a* illustrated in FIG. 6, a sufficient clearance is kept between the supply screw 106 and the upper side of the casing 100. Specifically, although the clearance between the stirring screw 108 and the casing 100 is 5 mm, a clearance of 10 mm is kept above the supply screw 106.

In the developing device 4, the supply screw 106 and the stirring screw 108 are driven at an identical rotation speed.

From the image forming apparatus 500, the driving force to drive the supply screw 106 and the stirring screw 108 is initially transmitted, via the input gear 121, concurrently to the developing roller gear 122 and the supply input gear 123 to drive the supply screw 106. The driving force is then transmitted from the supply screw 106 via the supply output gear 124 disposed on the end side of the rotation shaft 106A of the supply screw 106 opposite the supply input gear 123 and further via the transmission gear 125 to the stirring input gear 126 to drive the stirring screw 108.

With the above-described train of driving of rotators of the developing device 4, namely, the developing roller 102, the supply screw 106, and the stirring screw 108, the supply screw 106 and the stirring screw 108 can rotate in an identical direction as indicated by arrows A and B illustrated in FIG. 6. With the supply screw 106 and the stirring screw 108 rotating in the identical direction, the developer lifted by the stirring screw 108 can be promptly received in the supply compartment 105 by the supply screw 106.

Descriptions are given below of such an effect attained by the supply screw 106 and the stirring screw 108 rotating in the identical direction, with reference to the drawings.

Figure 7A:
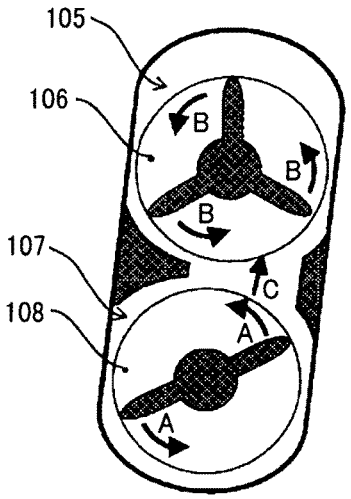
FIG. 7A is a cross-sectional view of a supply screw and a stirring screw rotating in an identical direction, of the developing device illustrated in FIG. 4.
Figure 7B:
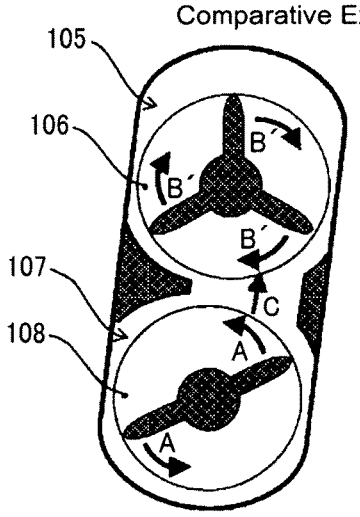
FIG. 7B is a cross-sectional view of a supply screw and a stirring screw rotating in the opposite directions, as a comparative example.

FIGS. 7A and 7B illustrate a relation between the rotation directions of the supply screw 106 and the stirring screw 108 and inhibition of stagnant of developer. FIG. 7A is a cross-sectional view of the supply screw 106 and the stirring screw 108 rotating in the identical direction as in the present embodiment, and FIG. 7B is a cross-sectional view of the supply screw 106 and the stirring screw 108 rotating in the opposite directions, as a comparative example.

In FIG. 7B, the supply screw 106 rotates clockwise as indicated by arrow B', and the stirring screw 108 rotates in the opposite direction (counterclockwise in FIG. 7B) as indicated by arrow A. In the structure illustrated in FIG. 7B, the developer lifted by the screw blade of the stirring screw 108 flows in the direction indicated by arrow C. The screw blade of the supply screw 106 exerts a force in a direction to push down the developer lifted by the stirring screw 108. Then, a portion of the developer is flipped down.

By contrast, in FIG. 7A, the supply screw 106 rotates counterclockwise as indicated by arrow B, and the stirring screw 108 rotates in the identical direction as indicated by arrow A. In this case, similarly, the developer lifted by the screw blade of the stirring screw 108 flows in the direction indicated by arrow C. However, a portion of the developer lifted by the stirring screw 108 is lifted by the screw blade of the supply screw 106 rotating in the identical direction and received in the supply compartment 105. Accordingly, the developer is inhibited from stagnating in the lifting area 109*a*. That is, the developer is smoothly forwarded in the lifting area 109*a*, and stagnant of developer is alleviated.

Therefore, rotating the supply screw 106 and the stirring screw 108 in the identical direction is advantageous in that the developer lifted by the stirring screw 108 is promptly received in the supply compartment 105 by the supply screw 106.

Additionally, at the start of driving of the developing device 4, the driving force from the input gear 121 is concurrently transmitted to the developing roller gear 122 and the supply input gear 123 and then transmitted to the stirring input gear 126. Thus, the driving force is sequentially transmitted to the supply input gear 123 and the stirring input gear 126 with play. Here, each gear is a toothed wheel.

Accordingly, the supply screw 106 driven by the supply input gear 123 starts rotating slightly earlier than the stirring screw 108 driven by the stirring input gear 126.

Accordingly, the developer in the lifting area 109*a* is loosened immediately after start of the driving, and a sharp rise of pressure of developer in the lifting area 109*a* at the start of driving is inhibited. Then, firm adhesion or aggregation of the developer is inhibited. If the developing roller 102 starts rotating earlier than the supply screw 106 to supply the developer to the developing roller 102, the amount of developer scooped thereby decreases transiently. Such an inconvenience in developer supply is inhibited in the present embodiment since the supply screw 106 is driven concurrently with the developing roller 102. Further, if the scooping of developer by the developing roller 102 is uneven, scattering of toner or contamination of the sleeve with toner can occur. If the scattering or contamination accumulates, image failure may occur. From these reasons, the developing roller 102 and the supply screw 106 are preferably driven concurrently.

Further, in the developing device 4 according to the present embodiment, the developer conveyors disposed in the supply compartment 105 and the stirring compartment 107 are screws (the supply screw 106 and the stirring screw 108). The supply screw 106 is triple threaded, while the stirring screw 108 is double threaded.

As described above, immediately after the start of driving of the developing device 4, the developer in the supply compartment 105 is loosened before the start of lifting of developer from the stirring compartment 107, thereby inhibiting a sharp rise of pressure of developer in the lifting area 109*a*. When the screws rotates at an identical rotation speed, the greater the number of screw threads, the greater the number of times the screw passes the accumulation developer. Accordingly, as the number of screw threads increases, the effect to loosen the developer improves (the developer conveyance efficiency in the axial direction improves). Accordingly, the screw having a greater number of screw threads can better inhibit the sharp rise of pressure of developer in the lifting area 109*a*.

Figure 9:
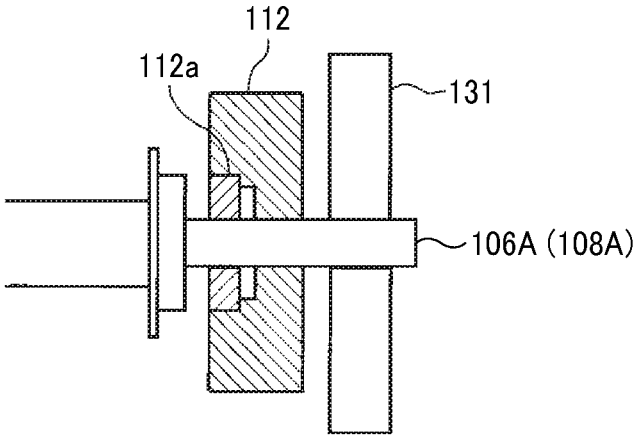
FIG. 9 is a schematic cross-sectional view, from a side, of a bearing portion and a seal of a rotation shaft of a conveying screw of the developing device illustrated in FIG. 4.

Additionally, the transmission gear 125, which is an idler gear having the shaft attached to or integral with the casing 100, easily generates heat due to friction with the shaft supporting the transmission gear 125. Similarly, in the bearing portions receiving the rotation shafts 106A and 108A of the supply screw 106 and the stirring screw 108, temperature tends to rise due to the sliding between seals 112*a* (illustrated in FIG. 9) provided in bearings 112 (illustrated in FIG. 9) and the surfaces of the rotation shafts 106A and 108A. Accordingly, temperature locally rises on the side of the developing device 4 on which the transmission gear 125 is disposed. Toner melts and solidifies at a predetermined temperature or higher than that. However, in the developing device 4 according to the present embodiment, the transmission gear 125 (the idler gear) is disposed on the side of the lifting area 109*a* filled with developer that is mobile. In this state, since the developer disperses the generated heat throughout the developing device 4 (the casing 100), a local temperature rise is not likely to occur, inhibiting aggregation of toner and firm adhesion of toner to the casing 100 and the seals 112*a*.

Here, the lifting area 109*a* in the developing device 4, where the developer is lifted, will be described in more detail with reference to the drawings.

Figure 8:
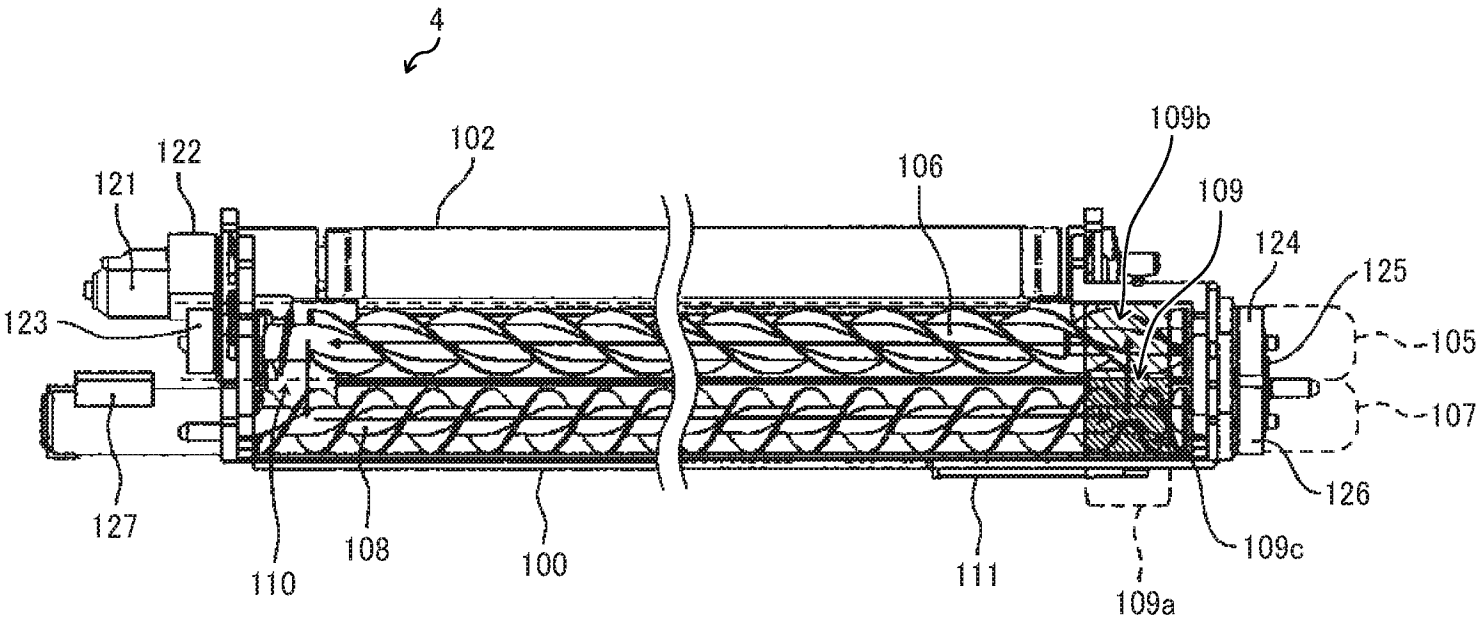
FIG. 8 is a cross-sectional view of the lifting area in the developing device illustrated in FIG. 4.

FIG. 8 is a cross-sectional view of the lifting area 109*a* extending in the supply compartment 105 and the stirring compartment 107 in the developing device 4.

As illustrated in FIG. 8, the lifting area 109*a* of the developing device 4 extends above and below the lifting opening 109 disposed on one end side in the longitudinal direction of the developing device 4.

The lifting area 109*a* includes a portion of the supply compartment 105 located above the lifting opening 109 (hereinafter "upper area 109*b*") and a portion of the stirring compartment 107 located below the lifting opening 109

(hereinafter "lower area 109*c*"). The area of the lifting opening 109, the upper area 109*b*, and the lower area 109*c* together serve as the lifting area 109*a*.

As described above with reference to FIG. 6, in the lifting area 109*a*, the clearance between the stirring screw 108 and the casing 100 is 5 mm, and the clearance above the supply screw 106 is 10 mm.

Accordingly, in the developing device 4, the upper area 109*b* (in the supply compartment 105) of the lifting area 109*a* is greater in capacity (dimension) than the lower area 109*c* (in the stirring compartment 107) of the lifting area 109*a*.

With this structure, the capacity of the upper area 109*b* in the supply compartment 105 is greater than the volume of developer lifted from the lower area 109*c* in the stirring compartment 107 immediately after the start of driving of the developing device 4. Accordingly, in the lifting area 109*a* including the upper area 109*b* and the lower area 109*c*, the developer moves smoothly.

The structures described above are just examples, and the various aspects of the present specification attain respective effects as follows.

Aspect A

As described above, the developing device according to an aspect of this disclosure includes the developer containing portions vertically arranged, such as the supply compartment 105 and the stirring compartment 107. The developing device 4 further includes a first developer conveyor (an upper developer conveyor), such as a supply screw 106, to convey developer in the upper developer containing portion (the supply compartment 105) and a second developer conveyor (a lower developer conveyor), such as a stirring screw 108, to convey developer in the lower developer containing portion (the stirring compartment 107), respectively. The first developer conveyor conveys the developer to one side in the axial direction of the first and second developer conveyors, and the second developer conveyor conveys the developer to the opposite side. The developing device 4 further includes a developer-lifting area (e.g., the lifting area 109*a* in the casing 100, extending above and below the lifting opening 109) in which the developer is lifted from the lower developer containing portion (the stirring compartment 107) to the upper developer containing portion (the supply compartment 105).

The drive input gear (e.g., the input gear 121) to input a driving force into the developing device 4 meshes with (or is coupled to) the first drive gear (the supply input gear 123) to rotate the first developer conveyor (the supply screw 106), and the driving force is transmitted via the first drive gear (the supply input gear 123) to the second drive gar (the stirring input gear 126) to rotate the second developer conveyor (the stirring screw 108).

With this configuration, the following effects are attained.

To the second drive gear (the stirring input gear 126) to rotate the second developer conveyor (the stirring screw 108), the driving force is transmitted via the first drive gear (the supply input gear 123). Accordingly, at the start of driving of the developing device, the first developer conveyor (the supply screw 106) disposed in the upper developer containing portion (the supply compartment 105) starts rotating slightly earlier than the second developer conveyor (the stirring screw 108) disposed in the lower developer containing portion (the stirring compartment 107). Starting the rotation of the supply screw 106 earlier than the rotation of the stirring screw 108 is advantageous in that the developer in the upper area (109*b*) of the developer-lifting area (the lifting area 109*a*) can be loosened before the developer is lifted from the lower area (109*c*) of the developer-lifting area (the lifting area 109*a*). Accordingly, this structure can inhibit the sharp rise of pressure of developer in the lifting area immediately after the start of driving.

According to this aspect, the developing device including the vertically arranged developer containing portions can inhibit clogging with developer and aggregation of developer caused by a rise in pressure of developer in the developer-lifting area (the lifting area 109*a*) immediately after the start of driving.

Aspect B

According to another aspect, the developing device includes a developer bearer such as the developing roller 102 to bear and convey the developer to the developing range opposing the image bearer such as the photoconductor 2, and the drive input gear (e.g., the input gear 121) meshes with (or is coupled to) a developing drive gear such as the developing roller gear 122 to rotate the developer bearer and the first drive gear such as the supply input gear 123.

With this configuration, in the structure in which the first developer conveyor (e.g., the supply screw 106) is the supply screw to supply the developer to the developer bearer (e.g., the developing roller 102), the supply screw and the developer bearer can start rotating simultaneously. Accordingly, the occurrence of shortage of supply of developer to the developer bearer is inhibited.

Aspect C

According to another aspect, in the developing device, the first developer conveyor (e.g., the supply screw 106) and the second developer conveyor (e.g., the stirring screw 108) rotate in an identical direction.

With this configuration, the following effects are attained.

In the comparative structure in which the upper screw (the supply screw 106) and the lower screw (the stirring screw 108) rotate in the different directions, the screw blade of the upper screw flips down a portion of the developer lifted by the lower screw. By contrast, in the structure in which the upper screw (the supply screw 106) and the lower screw (the stirring screw 108) rotate in the same direction, the screw blade of the upper screw can scoop up a portion of the developer lifted by the lower screw.

Accordingly, compared with the comparative structure in which the upper screw (the supply screw 106) and the lower screw (the stirring screw 108) rotate in the different directions, the developer can move smoothly in the developer-lifting area (e.g., the lifting area 109*a*), from the lower developer containing portion (e.g., the stirring compartment 107) to the upper developer containing portion (e.g., the supply compartment 105).

Aspect D

According to another aspect, the developing device further includes an idler gear (e.g., the transmission gear 125) coupled to the second drive gear (e.g., the stirring input gear 126), and the drive force is transmitted from the first developer conveyor (e.g., the supply screw 106) via the idler gear to the second drive gear to drive the second developer conveyor (e.g., the stirring screw 108). The term "coupled to" is intended to mean either indirect or direct connection.

Accordingly, with a simple structure, the first and second developer conveyors (the supply screw 106 and the stirring screw 108) are rotated in the same direction.

Aspect E

According to another aspect, the developing device further includes seals (e.g., the seal 112*a* in FIG. 9) disposed in both end portions of the rotation shafts (e.g., the rotation shafts 106A and 108A) of the first developer conveyor (the supply screw 106) and the second developer conveyor (the stirring screw 108) in the axial direction thereof, to seal gaps between the rotation shafts and bearings 112 supporting the rotation shafts, respectively. The idler gear (e.g., the transmission gear 125) is disposed on one side of the developing device in the longitudinal direction thereof on which the lifting area 109*a* (the lifting opening 109) is disposed.

With this configuration, the following effects are attained.

On the side of the developing device on which the idler gear, such as the transmission gear 125, is disposed (hereinafter "idler gear side"), temperature tends to rise due to the sliding between the idler gear and the bearing receiving the idler gear and between the rotation shafts (106A and 108A) of the first and second developer conveyors (the supply screw 106 and the stirring screw 108) and the seals disposed in the bearings receiving the rotation shafts. On the idler gear (the transmission gear 125) side on which temperature tends to rise, the lifting area 109*a* filled with developer that is mobile is disposed. With this structure, the heat generated on the idler gear (transmission gear 125) side can be dispersed by the developer in the lifting area 109*a* throughout the developing device 4 in the longitudinal direction thereof.

Since a local temperature rise on the idler gear (the transmission gear 125) side is inhibited, in the portion adjacent to the seals on the idler gear side, the aggregation of toner included in the developer and firm adhesion of toner to the walls defining the supply compartment 105 and the stirring compartment 107 and the seals can be inhibited.

Aspect F

According to another aspect, after a sequence of image forming process of the image forming apparatus (e.g., the image forming apparatus 500) using the above-described developing device completes, driving of the developing device is stopped, after which the drive input gear (e.g., the input gear 121) is rotated in reverse for a predetermined amount (i.e., reverse driving of the developing device).

This configuration can take a full advantage of the play of the second drive gear (the stirring input gear 126) of the second developer conveyor (the stirring screw 108) driven via the first developer conveyor (the supply screw 106), and, at the start of driving, the rotation of the first developer conveyor (the supply screw 106) can be started earlier than that of the second developer conveyor (the stirring screw 108), compared with a case in which the reverse driving is not performed.

Aspect G

According to another aspect, in the developing device, the upper area 109*b* (in the supply compartment 105) of the developer-lifting area (the lifting area 109*a*) is greater in capacity (dimension) than the lower area 109*c* (in the stirring compartment 107). In other words, the clearance around the first developer conveyor (defined by the casing 100) above the lifting opening 109 is greater than the clearance around the second developer conveyor (defined by the casing 100) below the lifting opening 109.

With this configuration, the capacity of the upper area 109*b* in the upper developer containing portion (the supply compartment 105) is greater than the volume of developer lifted from the lower area 109*c* in the lower developer containing portion (the stirring compartment 107) immediately after the start of driving of the developing device. Accordingly, in the lifting area 109*a* including the upper area 109*b* and the lower area 109*c*, the developer moves smoothly.

Aspect H

According to another aspect, in the developing device, the first and second developer conveyors (the supply screw 106 and the stirring screw 108) are conveying screws, and the number of screw threads of the first developer conveyor (the supply screw 106) is greater than the number of screw threads of the second developer conveyor (the stirring screw 108).

With this configuration, the number of times the screw threads of the first developer conveyor (the supply screw 106) convey the developer from the upper area 109*b* of the upper developer containing portion (the supply compartment 105) in the axial direction is greater than the number of times the screw threads of the second developer conveyor (the stirring screw 108) lift developer from the lower area 109*c* of the lower developer containing portion (the stirring compartment 107).

When the diameters of the screws are identical, the greater the number of threads, the higher the efficiency in conveyance. In the developer-lifting area, the first developer conveyor (the supply screw 106) is greater in conveyance force in the axial direction.

Additionally, when the diameters of the screws are identical, the screw loosens the developer more easily as the number of threads increases. In the configuration in which the first developer conveyor (the supply screw 106) is greater in thread number than the second developer conveyor (the stirring screw 108), the rise of pressure of developer immediately after the start of driving can be inhibited better.

Accordingly, in the state in which space is kept in the upper area 109*b* of the upper developer containing portion (the supply compartment 105), the developer is lifted from the lower area 109*c* of the lower developer containing portion (the stirring compartment 107). Accordingly, compared with a configuration in which the first developer conveyor (the supply screw 106) is not greater in thread number than the second developer conveyor (the stirring screw 108), the rise of pressure of developer immediately after the start of driving can be inhibited better.

Aspect I

According to an aspect of this disclosure, a process cartridge (e.g., the process cartridge 1) includes the developing device and at least one of an image bearer (e.g., the photoconductor 2), a charging device (e.g., the charging device 3), and a cleaning device (e.g., the photoconductor cleaning device 5) to clean the image bearer.

With this structure, the process cartridge can attain the effects similar to those described above.

Aspect G

According to an aspect of this disclosure, an image forming apparatus (e.g., the image forming apparatus 500) includes, to develop an electrostatic latent image on an image bearer (e.g., the photoconductor 2), either the developing device described above or the process cartridge described above.

With this structure, the image forming apparatus can attain the effects similar to those described above.

The above-described embodiments are illustrative and do not limit the present invention. Thus, numerous additional modifications and variations are possible in light of the above teachings. For example, elements and/or features of different illustrative embodiments may be combined with each other and/or substituted for each other within the scope of the present invention. For example, one or more of aspects of this disclosure are applicable to, not only copiers but also, printers, facsimile machines, and multifunction peripherals having one of capabilities of printing, facsimile transmission, copying, scanning, and the like.

What is claimed is:

1. A developing device comprising:

an upper developer container and a lower developer container arranged in a vertical direction, the upper developer container and the lower developer container configured to contain a developer;

a first developer conveyor configured to convey developer in the upper developer container to a first side in an axial direction of the first developer conveyor;

a second developer conveyor configured to convey developer in the lower developer container to a second side opposite the first side;

a developer-lifting area in which the developer is lifted from the lower developer container to the upper developer container;

a first drive gear configured to rotate the first developer conveyor;

a second drive gear configured to rotate the second developer conveyor;

a drive input gear configured to input a driving force to the developing device, the drive input gear coupled to the first drive gear and coupled via the first drive gear to the second drive gear to transmit the driving force to the second drive gear via the first drive gear;

a developer bearer configured to bear and convey the developer to a developing range opposing an image bearer; and a developing drive gear configured to rotate the developer bearer, wherein the drive input gear is configured to mesh with the developing drive gear and the first drive gear.

2. The developing device according to claim 1, wherein the first developer conveyor and the second developer conveyor are configured to rotate in an identical direction.

3. The developing device according to claim 2, further comprising:

an idler gear coupled to the second drive gear, wherein the drive force is transmitted from the first developer conveyor via the idler gear to the second drive gear.

4. The developing device according to claim 3, further comprising:

a bearing configured to receive each end portion of a rotation shaft of each of the first developer conveyor and the second developer conveyor; and a seal configured to seal a gap between the rotation shaft and the bearing, wherein the idler gear is on one side of the developing device in a longitudinal direction of the developing device, the one side on which the developer-lifting area is disposed.

5. The developing device according to claim 1, wherein, the drive input gear is configured to rotate in a first direction while meshed with the first drive gear during a sequence of an image forming process of an image forming apparatus using the developing device, and after the sequence of the image forming process of the image forming apparatus using the developing device completes, driving of the developing device is stopped, after which the drive input gear is configured to rotate in a second direction a set amount, the second direction being opposite the first direction.

6. The developing device according to claim 1, wherein the developer-lifting area includes:

an upper area located in the upper developer container; and a lower area located in the lower developer container, and wherein the upper area is greater in volume than the lower area.

7. The developing device according to claim 1, wherein the first developer conveyor and the second developer conveyor are conveying screws, and a thread number of the first developer conveyor is greater than a thread number of the second developer conveyor.

8. A process cartridge removably mountable in an image forming apparatus, the process cartridge comprising:

the developing device according to claim 1; and at least one of the image bearer configured to bear an electrostatic latent image developed by the developing device, a charger configured to charge the image bearer, and a cleaning device configured to clean the image bearer.

9. An image forming apparatus comprising:

the image bearer configured to bear an electrostatic latent image; and the developing device according to claim 1, the developing device configured to develop the electrostatic latent image with the developer.

10. The image forming apparatus according to claim 9, further comprising:

a charger configured to charge the image bearer; and a cleaning device configured to clean the image bearer, wherein the developing device and at least one of the image bearer, the charger, and the cleaning device are united into a process cartridge.

* * * * *